US006619906B2

(12) United States Patent
Dick

(10) Patent No.: US 6,619,906 B2
(45) **Date of Patent: *Sep. 16, 2003**

(54) POWER LATCH ADAPTER FOR QUICK CHANGE ATTACHMENT COUPLER

(76) Inventor: Dennis J Dick, 5541 Ridge Ave., SW., East Sparta, OH (US) 44626

( * ) Notice: Subject to any disclaimer, the term of this patent is extended or adjusted under 35 U.S.C. 154(b) by 64 days.

This patent is subject to a terminal disclaimer.

(21) Appl. No.: 09/804,343

(22) Filed: Mar. 12, 2001

(65) Prior Publication Data

US 2002/0127090 A1 Sep. 12, 2002

(51) Int. Cl.[7] ..... E02F 3/00
(52) U.S. Cl. ..... 414/723; 37/468
(58) Field of Search ..... 414/723; 37/468

(56) References Cited

U.S. PATENT DOCUMENTS

| | | | | |
|---|---|---|---|---|
| 3,269,570 A | | 8/1966 | Wallberg | 214/131 |
| 3,672,521 A | | 6/1972 | Bauer et al. | 214/145 |
| 5,010,962 A | * | 4/1991 | Bloom, Jr. | 414/723 X |
| 5,098,252 A | | 3/1992 | Sheesley et al. | 414/723 |
| 5,107,610 A | | 4/1992 | Fusco | 37/103 |
| 5,403,144 A | * | 4/1995 | Staben, Jr. | 414/723 X |
| 5,562,397 A | | 10/1996 | Albright | 414/723 |
| 5,692,855 A | * | 12/1997 | Burton | 414/723 X |
| 6,390,765 B1 | * | 5/2002 | Dick | 414/723 |

* cited by examiner

*Primary Examiner*—Donald W. Underwood
(74) *Attorney, Agent, or Firm*—Paul E Milliken; Ray L Weber

(57) ABSTRACT

An add on adapter for converting an attachment coupler on a skid steer vehicle from hand operated latching and unlatching to power operated latching and unlatching when connecting and disconnecting work implements or accessories to the attachment coupler of the vehicle. The adapter is a substantially rectangular box shaped housing having a front and a back wall defining a relatively thin interior compartment with the back wall having rearwardly extending members to attach the housing to a front wall of the attachment coupler of the vehicle. Inside the housing is a vertically mounted pair of latch pins which are moveable longitudinally by hydraulic actuators between a retracted or unlatched position and an extended to latched position. A forwardly extending lip at the top of the front wall engages a rearwardly extending flange on a work implement to be attached to the vehicle. The latch pins when in the extended position, protrude from the bottom of the housing and engage apertures in a rearwardly extending flange on the work implement to latch the implement securely in place on the adapter. The adapter can remain attached to the attachment coupler and different implements can be attached and detached by the vehicle operator from inside the vehicle cab by operating hydraulic controls which control the operation of the hydraulic actuators and the movement of the latch pins to a latched or unlatched position.

17 Claims, 5 Drawing Sheets

POWER LATCH ADAPTER FOR QUICK CHANGE ATTACHMENT COUPLER

FIELD OF THE INVENTION

This invention relates to quick change attachment devices for accessories or work implements on skid steer vehicles and in particular to an add on adapter for converting an attachment coupler from hand operated latching and unlatching to power operated latching and unlatching.

BACKGROUND OF THE INVENTION

In the past various quick attachment devices have been developed for skid steer loaders. U.S. Pat. Nos. 3,732,996 and 3,672,521 show quick attachment devices that are carried on the front of a loader arm and are used for quickly attaching and detaching various accessories, such as different types of buckets or grapples. These quick attachment devices have been utilized extensively by Melroe Company, a Business Unit of Clark Equipment Company and sold under the trade name BOBTACH.

Power operated, quick attachment devices have been also advanced in the past, such as the device shown in U.S. Pat. No. 3,269,570. Also a power operated device for backhoes is illustrated in U.S. Pat. No. 5,107,610.

A skid steer loader adapter for an implement mounting plate is shown in U.S. Pat. No. 5,098,252 and uses a spring biased mechanism that is biased toward a retracted or released position. An over center wedging mechanism engages hook members to overcome a spring force and the locking mechanism is forced into engagement with the implement being mounted. U.S. Pat. No. 5,62,397 shows a way of adapting the BOBTACH system to power operation by attaching a power actuator between an existing pair of hand levers which move a respective pair of latch pins or wedge members to a retracted or an extended position. The power actuator is retracted or extended between the hand levers to move them into position to retract or extend the latch pins.

The present invention makes it possible to instantly convert a hand operated coupler to a power operated coupler by attaching a converter assembly containing hydraulic actuators to the front surface of the existing coupler and connecting hydraulic lines from the vehicle to connection nipples on the converter assembly. By operating on/off valves in the operators cab, hydraulic latch pins in the converter can be extended or retracted hydraulically rather than manually when the vehicle attachment such as a bucket or the like is being connected to or disconnected from the coupler of the vehicle.

SUMMARY OF THE INVENTION

The invention is an attachable adapter for converting an attachment coupler on skid steer vehicles from hand operated latching and unlatching to power operated latching and unlatching for attaching and detaching a work implement for use by the vehicle, the adapter comprising: a substantially rectangular box shaped housing having, a front wall, a back wall, interconnecting means extending transversely between the front and back wall and holding said walls in spaced apart relationship to define an interior compartment within the housing, attachment means on the back wall for fastening the housing to an attachment coupler on a skid steer vehicle, a forwardly extending member on the front wall positioned to engage a rearwardly extending member on a work implement to be used by the skid steer vehicle, a pair of longitudinally moveable latch pins mounted within the housing, the latch pins being moveable between a retracted position within the housing and an extended position in which part of each latch pin extends outside the housing for a predetermined distance, power actuator means within the housing operatively attached to the latch pins to move them between the retracted and the extended positions, the latch pins being mounted at such a location with respect to the housing that when in the extended position they will engage appropriately positioned apertures on a rearwardly extending member on the work implement to be attached to the power adapter.

DETAILED DESCRIPTION OF THE INVENTION

Figure 1:
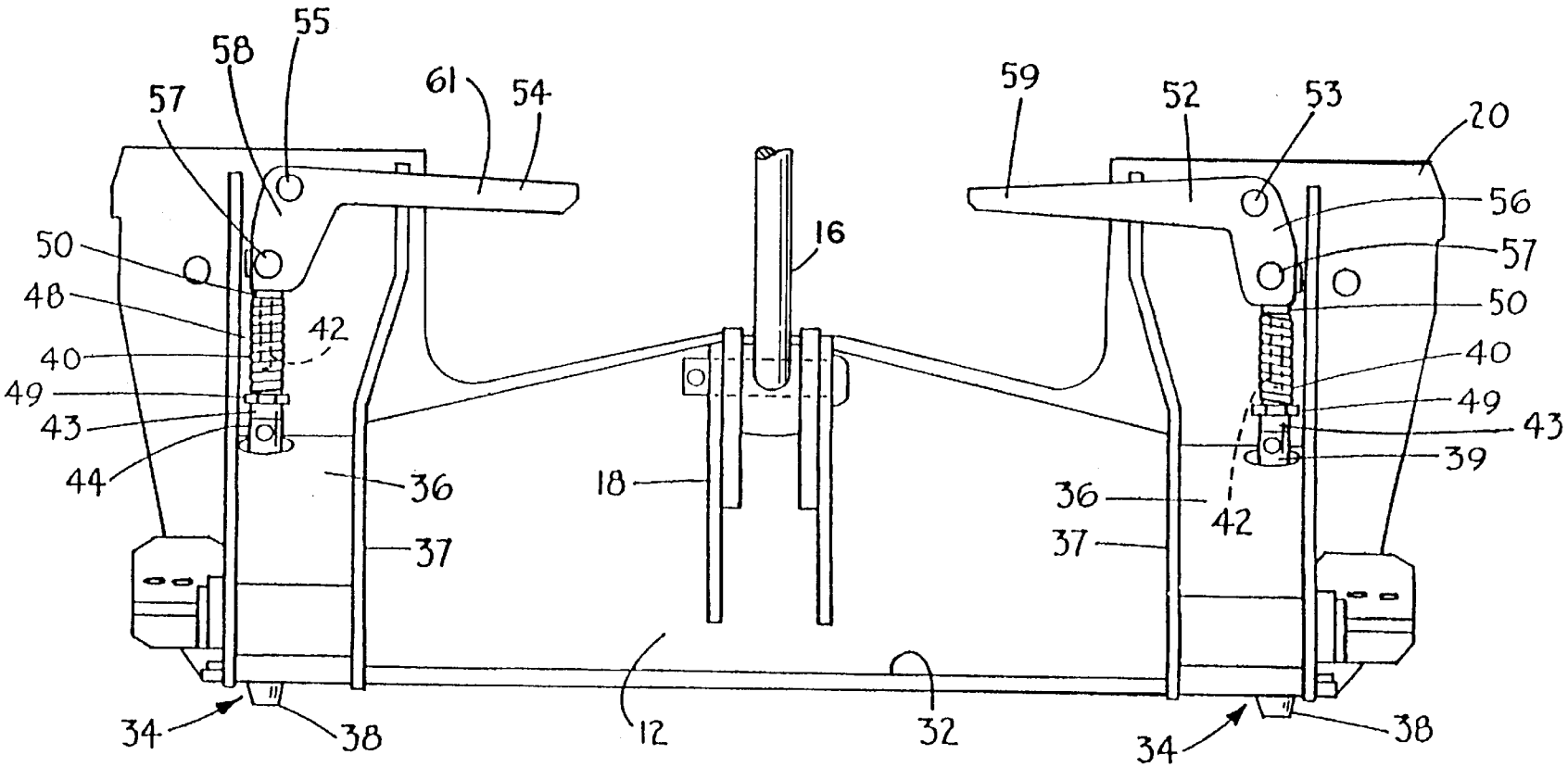
FIG. 1 is an elevational view of an attachment plate having manually operated levers for moving latch pins in a longitudinal direction to an extended or retracted position on the attachment plate.
Figure 2:
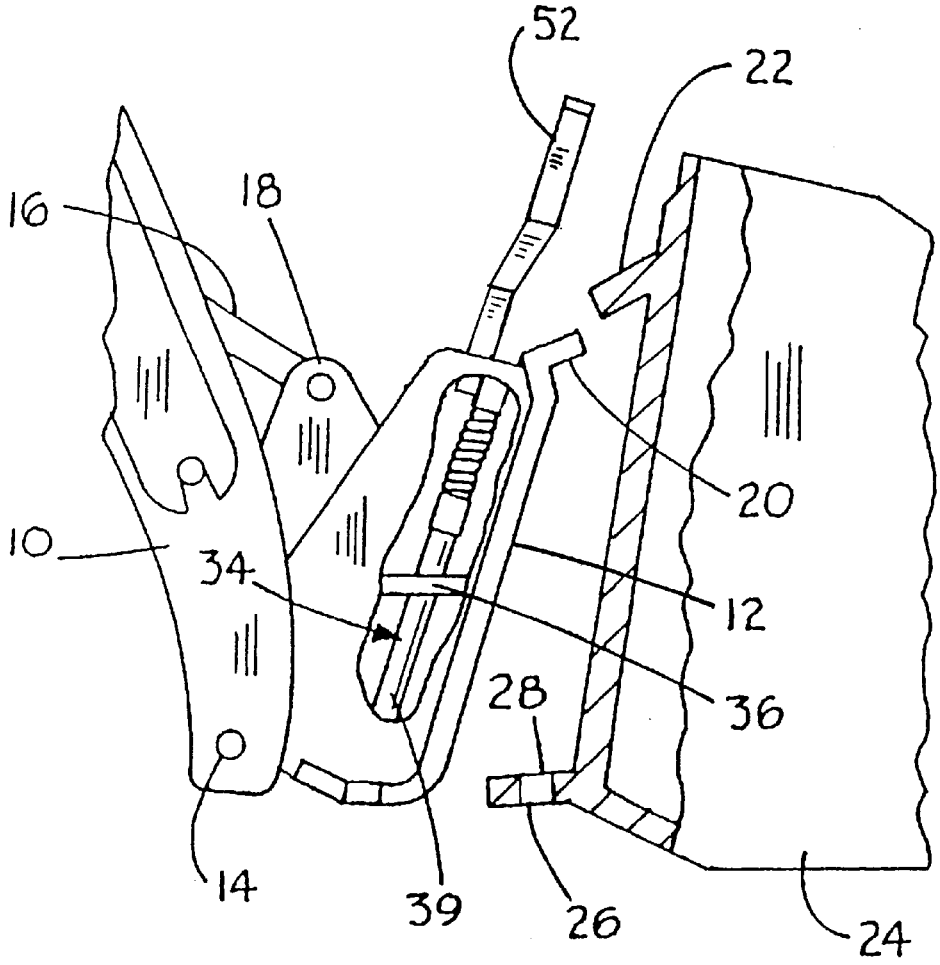
FIG. 2 is a side elevational view of the attachment plate of FIG. 1 mounted on loader arms of a skid steer vehicle showing the latch pin in a manually retracted position and with the attachment plate adjacent to a fragmentary portion of a bucket attachment which will be engaged by the attachment plate and fastened to the plate by extended latch pins.

As shown in FIGS. 1 and 2, a loader arm 10 of conventional construction, has an attachment mounting plate 12 pivotally mounted on the arm about pivots 14. The tilting of the attachment plate 12 is controlled by an actuator, the extensible and retractable rod of which is shown as 16, attached to a suitable bracket 18 on the attachment mounting plate 12. As can be seen in FIG. 2, the attachment mounting plate 12 includes a lip 20 that will fit under a flange 22 on an attachment such as a loader bucket indicated at 24. The is a flange on the lower edge of the back wall on each side of the bucket. One side of the attachment plate is shown for the sake of illustration. A lower flange 26 is also supported on the attachment or bucket 24, and as can be seen, the lower flange 26 has an aperture 28 that will align with an aperture 30 is a lower support flange 32 of the attached mounting plate or frame 12. A sliding latch pin or wedge 34 is mounted in a suitable guide plate (or plates 36 that forms part of a latch pin and actuator housing 37 on the mounting plate 12 as shown in FIG. 1.

The latch pin 34 will move up or down in a vertical direction. As can be seen in FIG. 1, the latch pin 34 has a tapered wedge end 38, to aid in pushing the wedge or latch pin 34 into the desired aperture on the attachment or bucket 24 when it is in position to be mounted. The latch pin 34 also has a shaft portion 39 that is slidable guided in suitable guides. The upper end of shaft portion 39 of wedge 34 is pivotally mounted to a conventional wedge actuator shaft assembly 40, which has a housing 43 at the lower end. The housing 43 has a bifurcated end 44 that receives a pivot pin 46 used for coupling the housing 43 to the end of shaft portion 39 of wedge 34.

A coupling end 50 is connected to a shaft member 42 that is slidably coupled to the housing 43. A spring 48 acts between an adjusting nut 49 and coupling end 50 at the upper end of the telescoping shaft assembly 40. The arrangement is conventional and will load the wedge downward to lock the wedge as well as upward. Thus, it is shown schematically.

The upper ends of each of the shaft assemblies 40 are connected to a separate lever 52 and 54, respectively, on opposite sides of the attachment mounting plate 12. The shaft assemblies 40 and the wedges 34 are identical on the opposite sides of the attachment mounting plate 12, except one is left-handed and one is right-handed. The levers 52 and 54 are pivotally mounted to the attachment mounting plate 12 on suitable pivot supports 53 and 55 respectively. The pivot supports 53 and 55 can be pins using bushings, or relatively low friction connections so that the levers 52 and 54 can pivot freely and easily. The actuator end of the levers 56 and 58, respectively, carry the pivot pins 57 for the connections that control the wedge members 34.

Handles 59 and 61 are provided on the levers 52 and 54 respectively, so that the parts can be manually operated. When the levers 52 and 54 are in the raised or vertical position as show in FIG. 2, the latch pins 34 are in the retracted position. When the levers 52 and 54 are moved into the downward or horizontal position shown in FIG. 1, the latch pins 34 are extended to engage an aperture on whatever attachment is to be mounted on the mounting plate 12.

In operation, to connect an attachment to the mounting plate 12, an attachment such as the bucket 24 shown in FIG. 2 is positioned adjacent to the mounting plate 12 and the mounting plate is moved against the bucket 12 with the lip 20 sliding beneath the flange 22 and the front face of the mounting plate 12 lying against the rear face of the bucket. This positions the mounting plate and the bucket with aperture 30 of the mounting plate and aperture 28 being in alignment with each other. The levers 52 and 52 are then moved to the lowered or horizontal position, shown in FIG. 1, and this causes the latch pins 34 to project downwardly through the apertures 30 and 28 and lock the bucket in position on the mounting plate 12.

Figure 3:
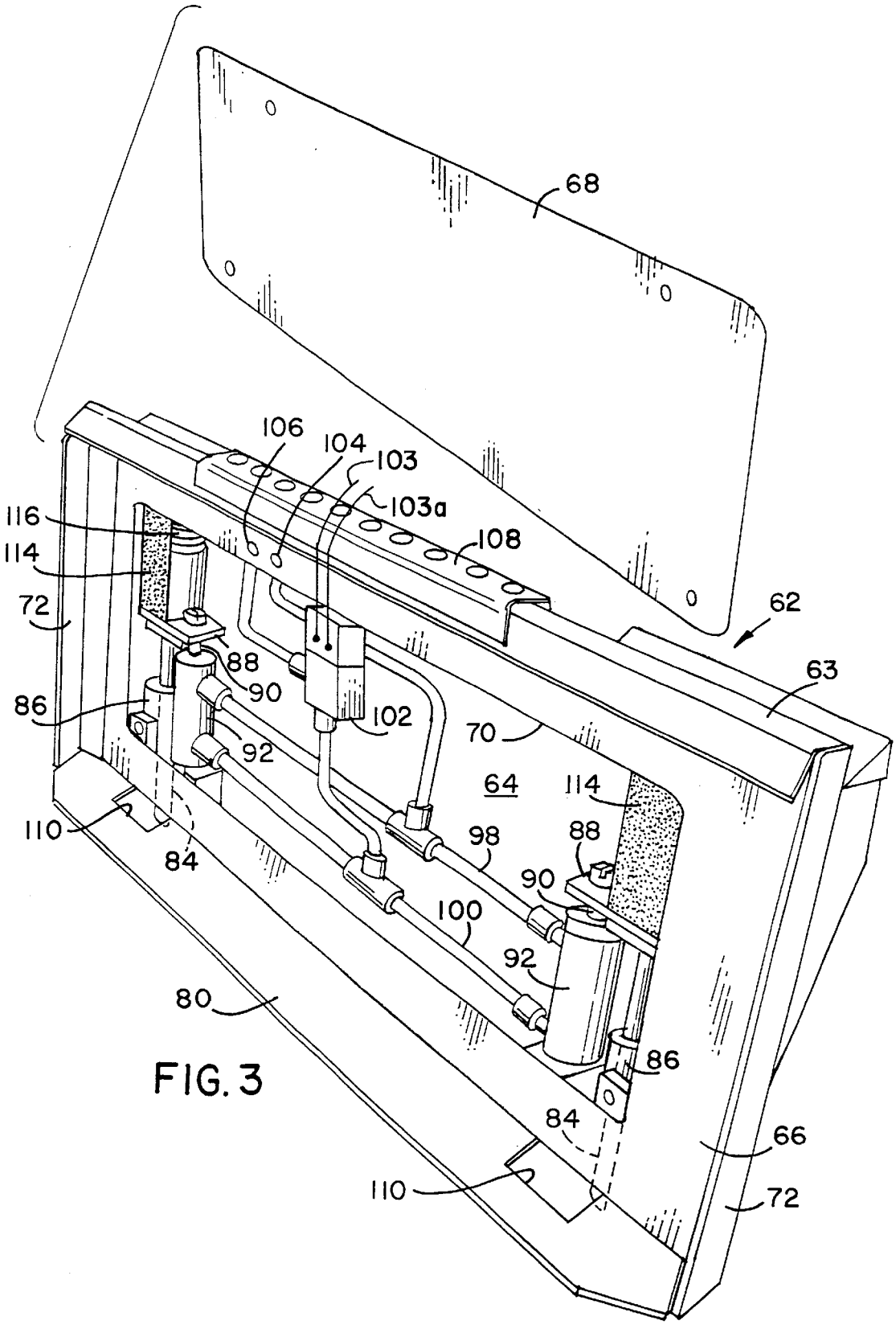
FIG. 3 is a perspective view of the power latch adapter unit which when attached to the front of the attachment plate shown in FIGS. 1 and 2, converts the attachment plate to a power latching coupler.

The foregoing description of the mounting plate 12 and the connection to the bucket 24 are known in the prior art but have been described to lay the background for an understanding of how the power latch adapter indicated generally by the numeral 62 shown in FIG. 3 is attached to the mounting plate 12 prior to mounting a bucket or other attachment thereon.

Figure 4:
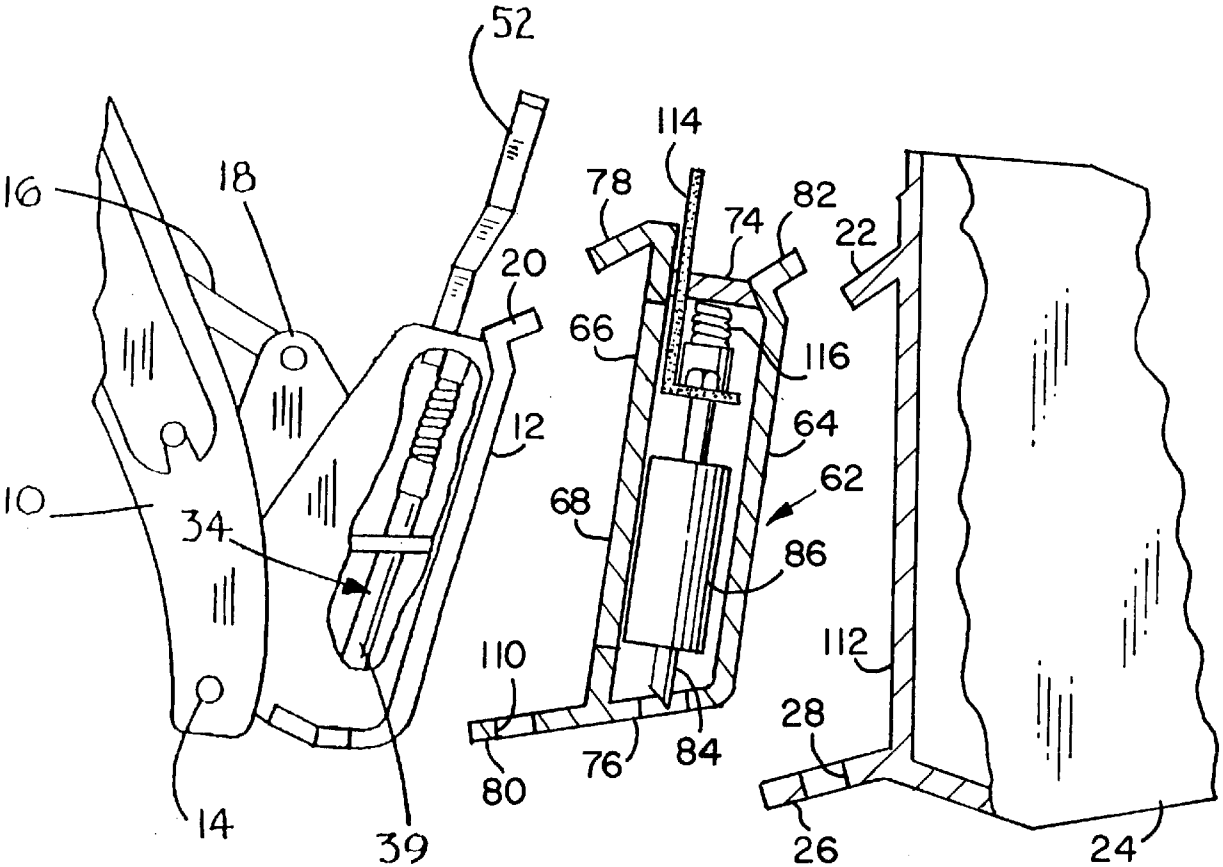
FIG. 4 is a fragmentary side elevational view showing the attachment plate and bucket of FIG. 2 with the power latch adapter of FIG. 3 positioned in relationship to how it will be connected to the attachment plate and bucket when in an operative working position on a skid steer vehicle.

Referring to FIG. 3, the adapter 62 is a substantially rectangular box shaped housing 63 and has a front wall 64 and a back wall 66 having a removable cover panel 68 mounted in an access opening 70 by screws not shown. The adapter 62 also has two end walls 72, a top wall 74 and a bottom wall 76. The adapter 62 also has an upper flange 78 and a lower flange 80 both extending rearwardly from the back wall 66. An upper lip 82 extends forwardly from the front wall 64 at the top there of. A longitudinally slidable latch pin 84 is mounted vertically in a guide 86 near each end of the adapter 62. Each of the latch pins 84 is attached by a connector plate 88 to a piston rod 90 of a hydraulic actuator 92. Each connector plate 88 is fastened to its respective piston rod 90 by a bolt 94. A vertical open/close indicator flag 96 extends upwardly from the plate 88 and is contained inside the adapter 62 when the latch pins are in the latched or extended position, and extend outside above the adapter 62 when the latch pins are in the retracted position as shown in FIG. 4.

Hydraulic line 100 extends through a solenoid valve 102 to port 106 and hydraulic line 98 extends directly to port 104, which ports connect directly to hydraulic supply lines, (not shown) leading from the housing 63 to hydraulic controls in the vehicle operator's cab for turning on and off the hydraulic pressure to the actuators 92 to retract and extend the latch pins 84.

Electric lines 103 and 103*a* lead from the solenoid valve 102 to a moment switch (not shown) in the operators cab, which must be held down to open the solenoid valve 102. The solenoid valve 102 remains normally closed to prevent hydraulic fluid from flowing through the lines 100 to the actuators 92. This prevents the actuators from inadvertently retracting the latch pins 84 until it is desired to disconnect the attachment from the vehicle. Also this permits additional auxiliary hydraulically driven accessories such as augers and the like to receive hydraulic pressure for operation without releasing hydraulic fluid to the ends of the actuators 92 which would cause the latch pins 84 to move to the unlatched position and cause the attachment to become disconnected from the vehicle.

The adapter 62 also has a pebbled step surface 108 on the top thereof to permit an operator of the equipment to step on the adapter with less likelihood of slipping. The lower flange 80 of the adapter 62 has an aperture 110 near each end thereof to receive latch pins 34 of the mounting plate 12 as will be explained later.

FIG. 4 illustrates the relative positions of the mounting plate 12, the power latching adapter 62, and the bucket 24 before they are connected together and shows how the lips and flanges of the attachable parts align the parts in a position that will permit latch pins 34 and 84 to extend through their respective apertures and lock the various attachable parts together when in use. It should also be noted that in FIGS. 3 and 4 an indicator flag 114 is attached to the plate 88 to move up and down when the latch pin 84 is moved from the retracted position of the extended position. As shown in FIG. 4 when the latch pin 84 is retracted, the indicator flag 11 extends above the adapter 62 where it is visible from the cab of the operator of the vehicle indicating to the operator the position of the latch pin 84.

In operation, the adapter 62 can be left permanently attached to the mounting plate 12 thereby using only the power operated latch pins 84 to connect and disconnect the bucket 24 or any other attachments which are to be used on the vehicle. In other words, the power latch pins 84 perform the connection and disconnection operation previously accomplished by moving the latch pins 34 by the hand levers 52 and 54.

Figure 5:
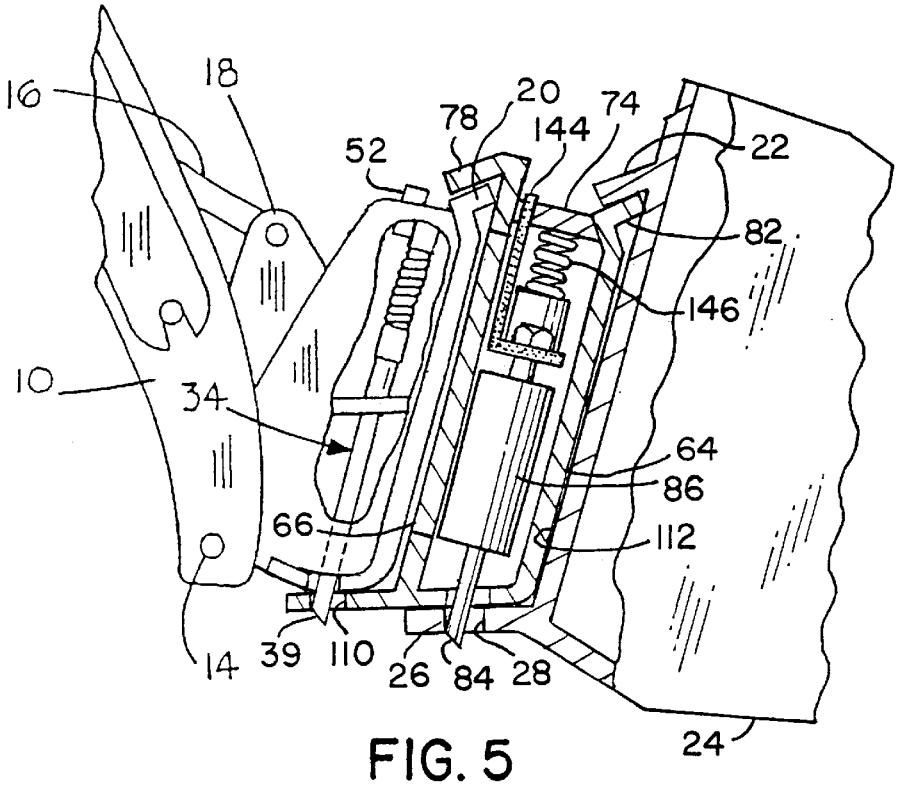
FIG. 5 is a fragmentary side elevational view of the items shown it FIG. 4 when assembled together in an operative position fastened together by slidable latch pins.

FIG. 5 shows the bucket 24 attached to the adapter 62 after it has been previously attached to the mounting plate 12 and locked in position by extending the latch pins 34 through the apertures 110 on the lower flanges 80 of the adapter 62. Once the adapter 62 is locked in position on the mounting plate 12, the adapter 62 is moved into position against the bucket 24 or other attachment.

In FIG. 5 a bucket 24 is attached to the adapter 62 by inserting the lip 82 beneath the flange 22 on the bucket 24 and moving the front wall 64 of the adapter against the rear wall 112 of the bucket 24 so that the aperture 28 is aligned with aperture 110 on the adapter 62, thus permitting the latch pin 84 to be extended to lock the bucket 24 in position on the adapter 62.

It should also be noted that a spring 116 is provided above the latch pin 84 to retain it in the extended or locked position in the event of loss of hydraulic power from the hydraulic actuators 92.

Figure 6:
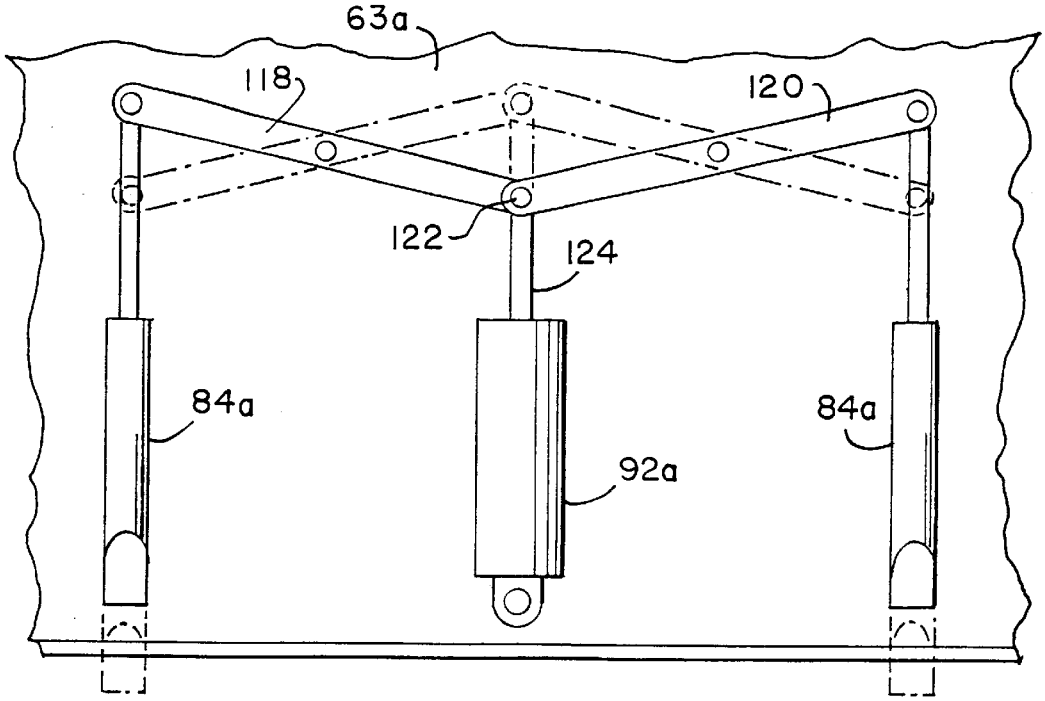
FIG. 6 is a schematic view of another embodiment of the adapter of FIG. 3 but having a pair of latch pins both operated by a single hydraulic cylinder rather than using a separate hydraulic cylinder for each latch pin.

As an alternative to the dual actuators 92 as used on the adapter 62 shown in FIG. 3, it is also possible to use a single hydraulic actuator 92*a* mounted on the housing 63*a* to operate both latch pins 84*a* through linkages 118 and 120 pivotally attached at pivot 122 to the piston rod 124 as shown in FIG. 6. The latch pins can also be operated by a single actuator by other linkage arrangements such as a single link between the latch pins.

These and various other modifications of the invention can be used without departing from the scope of the invention.

I claim:

1. An attachable adapter for converting an attachment coupler on skid steer vehicles from hand operated latching and unlatching to power operated latching and unlatching for attaching and detaching a work implement for use by the vehicle, the adapter comprising:

a substantially rectangular box shaped housing having;

a front wall;

a back wall;

interconnecting means extending transversely between the front and back wall and holding said walls in spaced apart relationship to define an interior compartment within the housing;

attachment means on the back wall for fastening the housing to an attachment coupler on a skid steer vehicle;

a forwardly extending member on the front wall positioned to engage a rearwardly extending member on a work implement to be used by the skid steer vehicle;

a pair of longitudinally moveable latch pins spaced apart from each other and mounted within the housing with one of the latch pins located near each end thereof, the latch pins being moveable between a retracted position within the housing and an extended position in which a lower end of each latch pin extends outside the housing for a predetermined distance;

a pair of power actuators within the housing each actuator being mounted in adjacent parallel side by side relationship with one of the latch pins and having a fixed portion attached to the housing and an elongated moveable portion having one end slideably engaging the fixed portion and an opposite end extending upwardly from the fixed portion and operatively attached to an upper end of the adjacent latch pin to cause the latch pin to move to either the retracted or the extended position depending upon the direction of movement of the moveable portion;

the latch pins being mounted at such a location with respect to the housing that when in the extended position they will engage appropriately positioned apertures on a rearwardly extending member on the work implement to be attached to the power adapter.

2. An adapter as claimed in claim 1 wherein the interconnecting means extending transversely between the front and back wall is a top wall, a bottom wall and a pair of end walls.

3. An adapter as claimed in claim 1 wherein the attachment means on the back wall is a rearwardly extending top flange for engaging a forwardly extending lip on the attachment coupler and a rearwardly extending bottom flange having apertures for receiving latch pins extending from the attachment coupler.

4. An adapter as claimed in claim 1 wherein the forwardly extending member is a lip at the top of the housing which engages a rearwardly extending flange at the top of the implement to be attached and wherein the latch pins when extending from the adapter housing engage apertures in a rearwardly extending flange at the bottom of the work implement.

5. An adapter as claimed in claim 1 wherein the latch pins are positioned vertically near each end of housing.

6. An adapter as claimed in claim 1 wherein each power actuator is a hydraulic actuator.

7. An adapter as claimed in claim 1 including an indicator means which is visible from the vehicle operators cab to enable the vehicle operator to determine whether the latch pins retaining a work implement are in a latched or unlatched position.

8. An adapter as claimed in claim 7 wherein the indicators are elongated flags extending above the housing when the latch pins are in the unlatched position.

9. An adapter as claimed in claim 1, including a fail safe means for retaining the latch pins in a latched position in the event of a loss of power to the power actuator means.

10. An adapter as claimed in claim 9 wherein the fail safe means is a spring biasing each latch pin in a latched position when there is a loss of power in the power actuator means.

11. An attachable adapter for converting an attachment coupler on skid steer vehicles from hand operated latching and unlatching to power operated latching and unlatching for attaching and detaching a work implement for use by the vehicle, the adapter comprising:

a substantially rectangular box shaped housing having;

a front wall;

a back wall;

interconnecting top, bottom and end walls extending transversely between the front and back wall and holding said walls in spaced apart relationship to define an interior compartment within the housing;

attachment means on the back wall for fastening the housing to an attachment coupler on a skid steer vehicle;

a forwardly extending member on the front wall positioned to engage a rearwardly extending member on a work implement to be used by the skid steer vehicle;

a pair of longitudinally moveable latch pins mounted vertically within the housing with one of the latch pins located near each end thereof, the latch pins being moveable between a retracted position within the housing and an extended position in which part of each latch pin extends outside the housing for a predetermined distance;

a pair of power actuators within the housing each actuator being vertically mounted in adjacent parallel side by side relationship with one of the latch pins and having a fixed portion attached to the housing and an elongated moveable portion having one end slideably engaging the fixed portion and an opposite end extening upwardly from the fixed portion and operatively attached to an upper end of the adjacent latch pin to cause the latch pin to move to either the retracted or the extended position depending upon the direction of movement of the moveable portion;

the latch pins being mounted at such a location with respect to the housing that when in the extended position they will engage appropriately positioned apertures on a rearwardly extending member on the work implement to be attached to the power adapter;

a power source associated with each actuator causing sliding movement of its respective moveable portion to an extended or retracted position with respect to its respective fixed portion; and control means to regulate the power provided to both actuators.

12. An adapter as claimed in claim 11 wherein the forwardly extending member is a lip at the top of the housing which engages a rearwardly extending flange at the top of the implement to be attached and wherein the latch pins when extending from the adapter housing engage apertures in a rearwardly extending flange at the bottom of the work implement.

13. An adapter as claimed in claim 11 wherein the power actuators are hydraulic power actuators.

14. An adapter as claimed in claim 11 including an indicator means which is visible from the vehicle operators cab to enable the vehicle operator to determine whether the latch pins retaining a work implement are in a latched or unlatched position.

15. An adapter as claimed in claim 14 wherein the indicator means are elongated flags extending above the housing when the latch pins are in the unlatched position.

16. An adapter as claimed in claim 11, including a fail safe means for retaining the latch pins in a latched position in the event of a loss of power to the power actuator means.

17. An adapter as claimed in claim 16 wherein the fail safe means is a spring biasing each latch pin in a latched position when there is a loss of power in the power actuator means.

* * * * *